United States Patent [19]

Whitlow

[11] 4,200,133

[45] Apr. 29, 1980

[54] GOLF BAG COVER

[76] Inventor: Stanley M. Whitlow, 206 Hickory St., Springhill, La. 71075

[21] Appl. No.: 33,843

[22] Filed: Apr. 27, 1979

Related U.S. Application Data

[63] Continuation of Ser. No. 871,614, Jan. 23, 1978, abandoned.

[51] Int. Cl.[2] ..... A63B 55/00

[52] U.S. Cl. ..... 150/52 G

[58] Field of Search ..... 150/52 G, 52 R, 1.5 R

[56] References Cited

U.S. PATENT DOCUMENTS

| | | | |
|---|---|---|---|
| 725,764 | 4/1903 | Pierce | 150/1.5 R |
| 1,092,729 | 4/1914 | Low et al. | 150/1.5 R |
| 2,704,563 | 3/1955 | Henrich | 150/1.5 R |
| 3,620,276 | 11/1971 | Taylor | 150/52 G |

*Primary Examiner*—Donald F. Norton

*Attorney, Agent, or Firm*—LeBlanc, Nolan, Shur & Nies

[57] ABSTRACT

A golf bag cover for protecting golf clubs during inclement weather is disclosed. The cover of this invention keeps clubs dry while in the bag, and, in addition, provides easy access and an unobstructed view thereof to facilitate selecting a club for play during such weather. The cover of this invention is a tubular sleeve of water impervious, preferably transparent, material having a frustoconical shape. A band of elastic surrounds and gathers the base and the top portions thereof in pleats, and the sleeve is sufficiently elongated so that when the base is fitted over the mouth of the bag, the upper portion of the cover will fold over the club heads. A club is then removed from the bag or returned thereto through the top of the cover. The cover of this invention is preferably constructed of crushable or nonselfsupporting plastic so that it may be collapsed to a compact package for storage.

2 Claims, 5 Drawing Figures

GOLF BAG COVER

This is a continuation of application Ser. No. 871,614 filed Jan. 23, 1978, now abandoned.

This invention relates to golf bag covers, and in particular to a golf bag cover for protecting clubs therein during inclement weather which will provide ready access to said clubs, and which is easy to attach and detach from the golf bag.

The prior art contains several different types of golf bag covers. Uniformly however, these covers are cumbersome and difficult to attach or detach from the golf bag, or do not keep clubs in the bag dry while a club is removed for use. In U.S. Pat. No. 2,718,251, and No. 2,985,212, covers are described which cover the entire bag and provide access through the top thereof, either through a flap, or through a zipper closed opening. In both instances, the cover is difficult to attach or detach, primarily because it covers the entire bag. In addition, the openings in the top thereof will not keep the clubs in the bag dry when a club is removed. Furthermore, because the entire bag is covered, the cover itself will be susceptible to wear or abrasion through normal useage of the bag. U.S. Pat. No. 3,754,587 also describes a cover which covers substantially the entire bag, but not the base thereof. A flap is provided across the top to cover an access opening. However, as in the previously described patents, the central opening must be uncovered in order to withdraw a club therethrough, and if the central opening is uncovered during inclement weather, the remaining clubs in the bag will not be protected.

U.S. Pat. No. 3,977,451 describes a rain cover hood type device for a golf bag. This device does not cover the entire bag, but only the mouth portion thereof and therefor may be removed with relative ease. However, access to the interior of the bag is provided through an opening which is covered by a separate flap. Because the flap is separate, it may be removed and lost by accident.

Accordingly, a need exists for a relatively simple, light weight golf bag cover which will protect clubs in the bag when a club is removed or returned therefrom. In addition, the cover should be readily attachable or removable, and collapsible to a compact shape for storage when not in use.

It has been discovered that the aforementioned problems may be solved by the golf bag cover of the instant invention. The cover of the instant invention comprises an elongated tubular sleeve of frustoconical shape. The base of the conical sleeve is adapted to be attached surrounding the mouth of the club bag. The sleeve is sufficiently elongated, and constructed of non-selfsupporting materials so that normally the extended upper portion of the cover will fold loosely over the club heads so that the top opening will hang downwardly. Therefore, when the bag is in use during inclement weather, rain will run from the bag cover without entering the top opening.

A resilient elastic band having a length less than the circumference of the golf bag is attached to the base of the cover of this invention. This continuous band then resistently retains the cover of this invention on the golf bag by engaging the outer surface thereof adjacent the mouth. The top of the cover of this invention also mounts a continuous elastic band substantially shorter or of a smaller diameter than the band engaging the club bag outer surface. Said upper or top elastic band is adapted to gather the upper portion of said cover in pleats whereby access to the interior of the bag is provided therethrough by expanding said elastic band.

The cover of this invention is preferably constructed of a crushable or non-selfsupporting plastic material that may be collapsed or folded to a compact package for storage when not in use. The cover of this invention is also preferably constructed of a transparent material so that clubs within the bag will be visible therethrough.

When a club is to be withdrawn from the bag, the upper or top elastic band is expanded and the player's hand inserted therethrough. The selected club is then removed through the top opening of the cover. When the club has been removed, the cover is allowed to fold over the club heads to thereby keep the clubs in the bag dry. A club which has been used is reinserted into the bag in the same manner. By providing a cover having a length of from eighteen inches to three feet, the upper portion thereof will fold over the club heads of the clubs in the bag so that even though the access opening does not have a closure thereon, clubs within the bag will remain dry while rain will harmlesly drain from the folded loosely hanging upper portion over the side of the bag.

Accordingly, it is an object of this invention to provide a golf bag cover for protecting golf clubs in said bag during inclement weather which may be easily attached and detached from said bag.

It is another object to provide a golf bag cover which will permit access to the interior of said bag during inclement weather to remove or return a club thereto without permitting rain to reach the other clubs in the bag.

It is still another object to provide a golf bag cover which elastically engages the outer surface of the mouth of the bag and which extends over the club heads therein so that rain falling on said cover will run down the cover and onto and over the outside of the bag.

It is still another object to provide a golf bag cover which is an elongated sleeve having a frustoconical shape with elastic means surrounding the top and bottom openings therein, the bottom opening being adapted to surround the external surface of the mouth or upper portion of the bag.

It is yet another object of this invention to provide a golf bag cover constructed of transparent, water impervious, non-selfsupporting material of frustoconical shape which is an elongated sleeve adapted to fit over the mouth or upper portion of a golf bag and extend over the club heads to fold thereover so that the access opening to the interior of said bag is normally downwardly directed so that water falling on said cover will run thereover and not enter the bag through said opening.

These and other objects will become readily apparent with reference to the drawings and following description wherein.

Figure 1:
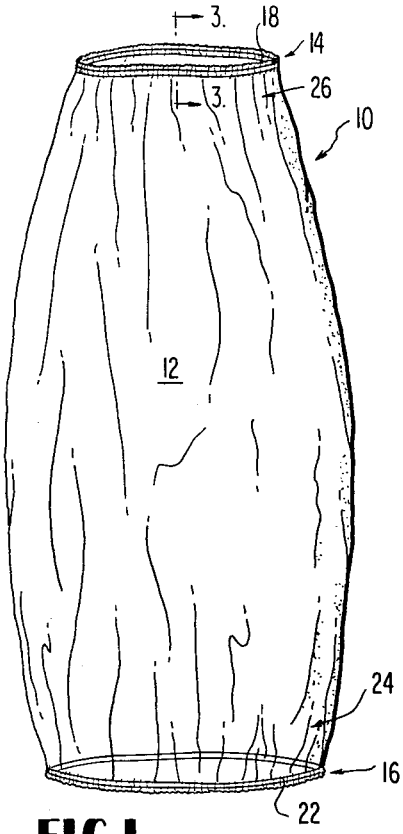
FIG. 1 is a perspective view of the golf bag cover of this invention.
Figure 3:
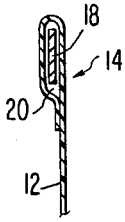
FIG. 3 is a cross-sectional view taken along line 3—3 of FIG. 1.
Figure 2:
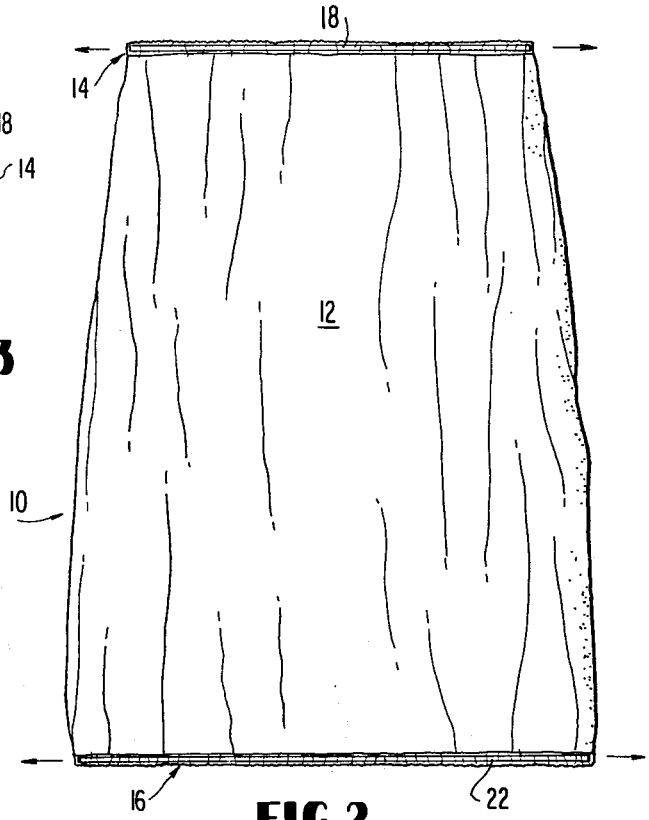
FIG. 2 is a view of the golf bag cover of FIG. 1 having the elastic bands therein fully extended.

With reference to the drawings, and to FIGS. 1–3 in particular, the golf bag cover of this invention 10 comprises an elongated sleeve 12 of preferably transparent, water impervious, plastic material. Said material, according to the preferred embodiment of this invention should be non-selfsupporting or crushable. As shown in FIG. 2, the sleeve 12 is of a frustoconical shape having an open top portion 14 and an open bottom portion 16.

The diameter of said open bottom portion 16 should be sufficiently large to receive the mouth or upper portion of a golf bag. The diameter of the upper portion or top opening 14 should be sufficiently large to receive a hand and permit withdrawal of a club therethrough or the return of a club therethrough to the golf bag, as will be subsequently explained.

The upper opening 14 is surrounded by an elastic band 18 as shown in FIG. 3 which is retained at said opening by an overlapping of the upper portion of the sleeve 12 to form a continuous channel 20.

Similarly, an elastic band 22 is retained in an overlapping channel formed by the sleeve 12 at the lower opening portion 16. Band 22, in an unflexed configuration should have a length less than the circumference of the outer surface of the mouth portion of a golf bag so that band 22 will retain the device 10 on a golf bag, as will be subsequently explained.

Because bands 18 and 22 are shorter in length than the circumference of openings 14 and 16, in an unflexed position as shown in FIG. 1, band 22 holds the lower portion of device 10 in a pleated configuration 24. Similarly, band 18 holds the upper portion 14 of device 10 in a pleated configuration 26 in both the flexed and unflexed positions shown in FIGS. 1 and 2, the diameter of the upper opening 14 is substantially less than the diameter of the lower opening 16 of device 10.

Figure 4:
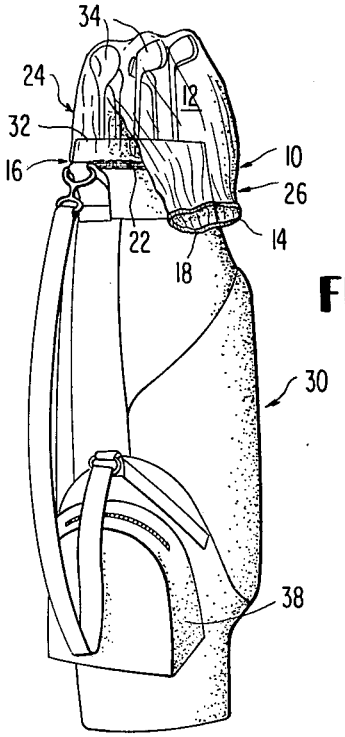
FIG. 4 is a perspective view of a golf bag cover of this invention mounted on a bag of clubs.

FIG. 4 depicts the device of this invention 10 mounted on a golf bag 30. As shown in FIG. 4, band 22 in the lower portion 16 engages the cover 10 about the mouth 32 of gold bag 30 so that in a normal configuration, the cover 10 extends upwardly from the mouth 32 of the bag over the club heads 34 disposed therein and the upper portion 14 gathered in pleats 26 by elastic band 18 overlies and folds over the club heads 34 so that the opening 14 is normally directed downwardly. Rain striking the cover 10 then will merely run down said cover along the pleated portions 26 or 24 and onto the external surface of the bag 30.

Figure 5:
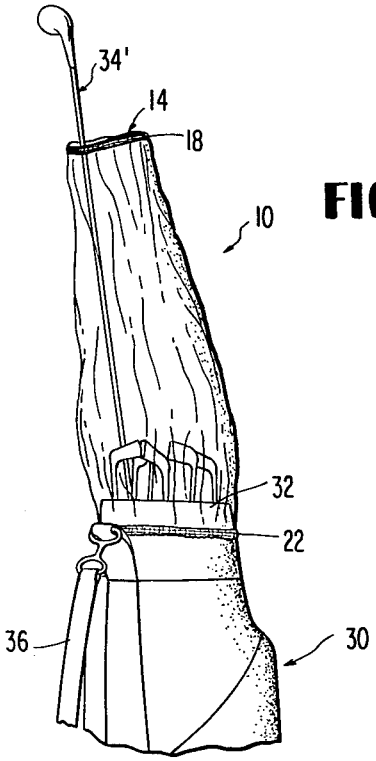
FIG. 5 is a fragmented view of the device of FIG. 4 illustrating withdrawal of a club from said bag when said bag is in a vertical position.

FIG. 5 illustrates removal of a golf club 34′ from bag 30, through cover 10. As shown therein, in order to remove the club 34′, the cover 10 is extended and the club withdrawn through the upper portion opening 14 through the elastic band 18.

As will be obvious to those skilled in the art however, if bag 30 is disposed at an angle to the vertical position shown in FIG. 5, club 34′ may be readily removed from bag 30 without permitting rain falling thereon to enter the mouth of the bag 32 and wet the clubs therein. If the bag 30 is carried by the shoulder strap 36, it will be carried at nearly a horizontal angle. If the bag is mounted on a conventional carriage, it will be disposed normally at an acute angle when a club is withdrawn therefrom. In either event then, during normal useage of the cover of this invention, clubs may be withdrawn or returned to the golf bag without exposing the opening 14 in cover 10 to the vertical which would permit rain to enter the bag.

Because the cover 10 of this invention is preferably constructed of a crushable or non-form retaining material, when not in use, it may be folded to a compact position and stored for example in the storage pocket 38 normally found on golf bag 30. In the alternative, as will be obvious to those skilled in the art, the cover of this invention may be folded to a compact position and placed in a jacket pocket, or the like.

Accordingly, a simple and highly useful cover for a golf bag has been disclosed herein which cover is readily attachable or detachable to the golf bag and which cover protects the clubs in the bag during inclement weather. In addition, the cover of this invention will permit a player to take a club from the golf bag during a rain storm without permitting rain to enter the bag, and will permit the return of the club.

The cover of this invention comprises a frustoconical tubular sleeve having elastic or flexible bands surrounding upper and lower openings to gather the upper and lower portions thereof in pleats. The lower portion is expanded to receive the mouth portion of a golf bag. The cover of this invention is constructed from a non-selfsupporting material so that when the cover is mounted on a golf bag, the upper portion thereof will lie over the club heads of the clubs in the bag so that the upper access opening is normally downwardly directed. In this way, rain falling on the cover of this invention will not enter the bag but will run off of the cover and down the external surface of the bag.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced herein.

What is claimed and desired to be secured by U.S. Letters Patent is:

1. A golf bag cover for protecting clubs therein during inclement weather, comprising:

an elongated, tubular sleeve having a frusto-conical configuration formed of non-selfsupporting, water impervious material, said sleeve defining an upper access opening and a lower opening of greater circumference;

a first continuous elastic band having a circumference less than the upper opening and disposed surrounding the opening; means integral with said sleeve for enclosing said first band;

a second continuous elastic band having a circumference less than the lower opening and greater than said first band disposed surrounding the lower opening; means integral with said sleeve for enclosing said second band so that when the upper portion of a golf bag is received within the sleeve through the lower opening said second band will engage the external surface thereof to mount said sleeve on the bag, whereby the sleeve will extend upwardly over the clubs therein and normally fold over the clubs with the access opening directed downwardly.

2. The cover of claim 1 wherein said sleeve is not more than three feet long.

* * * * *